United States Patent [19]

Rosendahl, Jr.

[11] Patent Number: 4,676,358

[45] Date of Patent: Jun. 30, 1987

[54] COIN CONTROL SYSTEM

[76] Inventor: Warren G. Rosendahl, Jr., 8050 Calderwood La., Cincinnati, Ohio 45243

[21] Appl. No.: 792,300

[22] Filed: Oct. 28, 1985

[51] Int. Cl.[4] ..... G07F 3/02; G07F 17/32

[52] U.S. Cl. ..... 194/203; 194/241; 194/320; 194/334; 194/344; 194/350

[58] Field of Search ..... 194/203, 240, 241, 317, 194/320, 334, 335, 344, 350, 338

[56] References Cited

U.S. PATENT DOCUMENTS

| | | | |
|---|---|---|---|
| 920,697 | 5/1909 | Vandiver | 194/335 |
| 2,604,259 | 7/1952 | Anderson . | |
| 2,948,379 | 8/1960 | Hensley, Jr. | 194/212 |
| 3,046,803 | 7/1962 | Bowman | 194/241 X |
| 3,083,896 | 4/1963 | Cairelli et al. . | |
| 3,200,923 | 8/1965 | Shontz, Jr. et al. | 194/346 |
| 3,211,267 | 10/1965 | Beyha | 194/317 X |
| 3,333,764 | 8/1967 | Pennell . | |
| 3,455,427 | 7/1969 | Tinsley, Jr. | 194/253 |
| 3,589,493 | 6/1971 | Hall | 194/334 |
| 3,822,004 | 7/1974 | Bolen | 194/241 X |
| 3,980,168 | 9/1976 | Knight et al. | 194/320 X |
| 4,037,700 | 7/1977 | Heraty | 194/350 |
| 4,098,386 | 7/1978 | Martin | 194/336 |
| 4,327,824 | 5/1982 | Nicholson | 194/203 |
| 4,349,095 | 9/1982 | Lewis | 194/318 |
| 4,460,004 | 7/1984 | Furuya | 133/8 R |
| 4,546,868 | 10/1985 | Gregory | 194/203 |

FOREIGN PATENT DOCUMENTS

| | | | |
|---|---|---|---|
| 529568 | 7/1931 | Fed. Rep. of Germany | 194/335 |
| 2054929 | 2/1981 | United Kingdom | 194/334 |

*Primary Examiner*—F. J. Bartuska

*Attorney, Agent, or Firm*—Wood, Herron & Evans

[57] ABSTRACT

A coin control system for determining whether proper coinage has been inserted to start a coin operated device. The coin in vertical orientation falls onto an inclined ramp, down which it rolls past a mechanism which detects magnetic materials. The coin rolls past a photocell which projects a beam positioned to be interrupted by only the upper limb or arc of the rolling coin. The ramp is mounted between closely spaced side plates and may be vertically adjusted between them with respect to the photocell so that it can be set for coins of different sizes. The coin control mechanism and a coin collection box are each separately lockable within a housing and are both further protected by a specially removable, lockable cover.

11 Claims, 4 Drawing Figures

COIN CONTROL SYSTEM

This system relates to coin control systems of the type which are used with coin operated devices such as children's rides, vending machines, laundry machines, and the like.

BACKGROUND

The prior art is replete with coin control systems which have been developed to determine whether proper coinage has been inserted to operate coin operated devices, and to detect the use of coins of improper size, weight, magnetic character, and other criteria. Such coin control mechanisms have become increasingly more complex as the art has developed. It has, therefore, been the object of this invention to provide a simple and accurate mechanism which will detect the use of oversize coins, undersized coins, and magnetic coins, and wherein the system has no moving parts but can be adjusted to accommodate coins of different sizes, and which can prevent retraction of the inserted coinage after the controlled device has been set in operation.

BRIEF DESCRIPTION OF THE INVENTION

In accordance with this invention a pair of vertical spaced apart side plates is provided, having a horizontal space between them sufficient to accommodate the passage of a coin in vertical orientation. An inclined ramp is arranged between the side plates, beneath a coin insert opening. The coin insert opening is positioned above the upper end of the ramp, so that a coin inserted through the opening falls in vertical orientation between the side plates onto the ramp, then rolls on down the ramp past various detectors and sensors, and ultimately drops off the lower end of the ramp into a coin collection box.

The side plates confine the coin to rolling down the ramp so that it cannot jam or become stuck. The coin moves by gravity; it is not mechanically pushed. The outer faces of the side plates may mount associated electrical circuitry, a timer, sound generator, or the like.

The ramp is preferably provided by a ramp member having a canted head, the upper surface of which forms the ramp, and a lower leg which is mounted for sliding movement between guides so that the ramp can be adjusted upwardly or downwardly in relation to a coin size determining photocell. Vertical movement of this ramp with respect to the position of the photocell enables the mechanism to be set to correspond to coins of different sizes. It can be fixed in a given position as by a set screw or detent.

At the coin insert opening a vertical limit or stop is provided which prevents the insertion of coins larger than a predetermined or maximum diameter. A magnet is fixed in a side plate, adjacent the path of coin movement down the ramp, and a magnetically responsive means such as a magnetic reed switch is also positioned adjacent the magnet. The reed switch is held in a first or normal position by the magnet unless a magnetic slug rolls down the ramp and alters the flux between the magnet and the reed switch. This causes the reed switch to change from its normal position to a second position such that the coin operated device is not activated by the slug.

A photocell arrangement responds just to the upper arc of the coin and determines whether the coin, the maximum size of which has already been preestablished at the entrance, corresponds to a predetermined minimum diameter. As the coin moves down the ramp, its upper portion or arc interrupts a narrow beam of light (which may be infrared) which is projected across the ramp from a light source on one side to a receiver on the other side. If the coin is too small, the beam is not interrupted, and the coinoperated device is not started. The beam is connected so that it must be interrupted for the mechanism to be started.

A dog or ratchet hangs between the side plates above the ramp and is mounted for swinging movement in the direction of coin movement down the ramp, but is blocked against movement in the reverse direction, past a given point, so that once a coin has rolled past this ratchet it cannot thereafter be retrieved by pulling it back up the ramp past the dog.

The coin control system or mechanism may be enclosed within a rectangular metal box which can be mounted on a post; or it can be housed integrally with the coin-operated device itself. The coin control mechanism is preferably removable from and lockable to its housing, so that it can be removed for maintenance or adjustment. The coin box, located adjacent to the ramp, is preferably a separate lockable and removable unit, so that the coin control mechanism and the coin box can each be separately locked or removed, without the other. Preferably both the coin control mechanism and the coin box are further protected by a specially lockable cover for the mounting box.

The invention can best be further described by reference to the accompanying drawings, in which.

Figure 1:
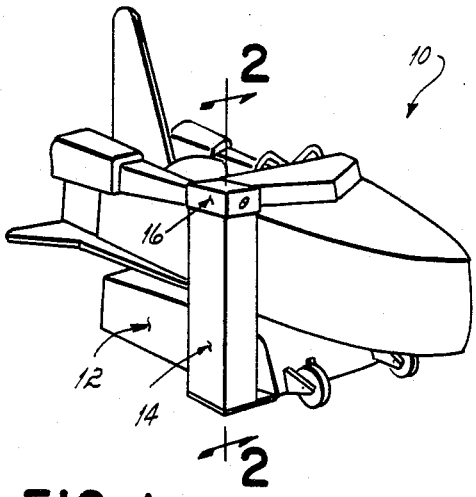
FIG. 1 is an isometric elevation of a coin control mechanism in accordance with a preferred form of the invention, as used to control the operation of an amusement ride.

As seen in FIG. 1, the coin control mechanism of this invention can be used, among other purposes, to control a coin operated children's ride such as the "space shuttle" ride shown at 10. The ride includes a drive motor indicated diagrammatically at 12. When a proper coin (e.g., a quarter) is inserted into the coin control system 18, motor 12 is energized for a predetermined period of time. For such use the coin control mechanism 18 may be housed in a free-standing post or column 14, adjacent to ride 10, but for other applications (e.g., a vending machine) it may be housed within the device itself. Post 14 may be a rectangular box-like column having a locked-on cap or cover 16. Preferably the coin control mechanism 18 is contained in a sleeve 19 which is removable from post 14. Sleeve 19 is secured to the post by a lock 20 having an arm or bolt which can be turned or shifted relative to an internal projection, or cooperating slots in the sides of the post.

Post 14 is provided with a coin slot 22 (FIG. 2), into which a coin is inserted to operate ride 10. The coin control mechanism 18 determines if the proper coinage has been inserted; as will be described, the coin falls through the mechanism 18 and preferably passes from it into a separately lockable, removable coin box 24, also housed within post 14.

Figure 3:
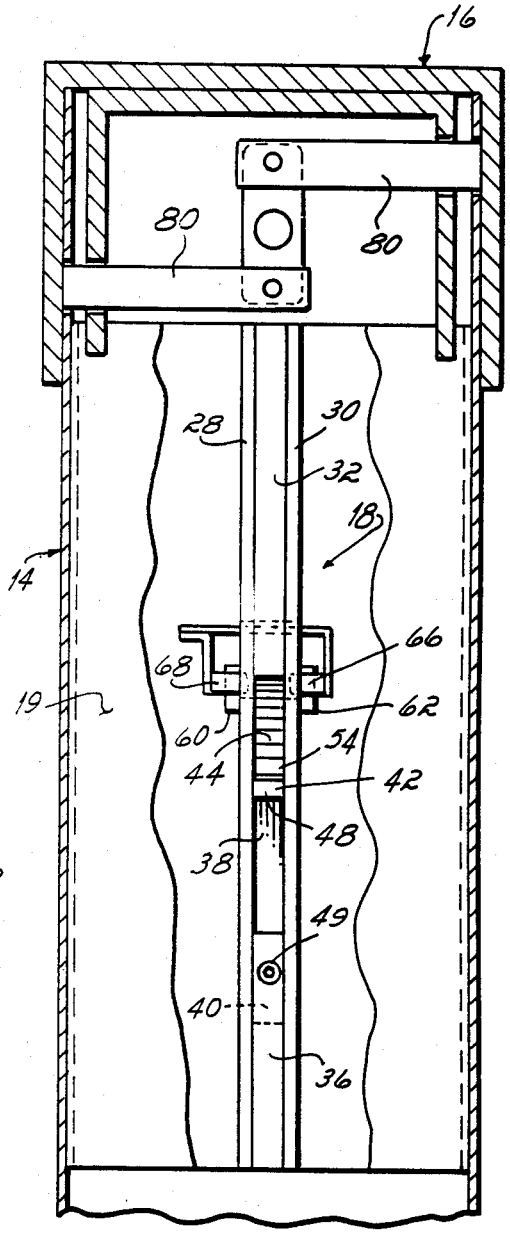
FIG. 3 is a vertical elevation taken on line 3—3 of FIG. 2.
Figure 2:
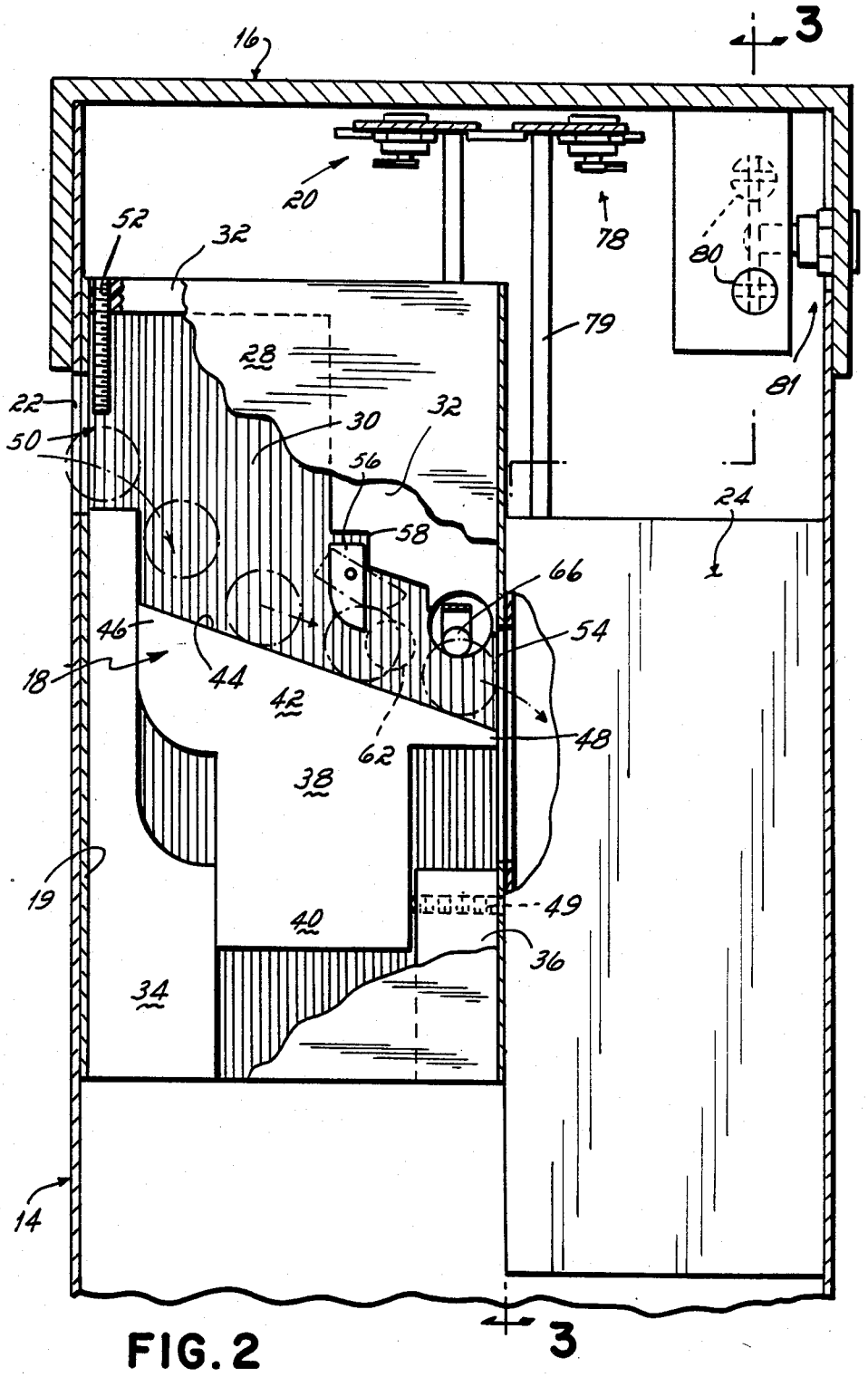
FIG. 2 is an enlarged vertical section taken on line 2—2 of FIG. 1, and diagrammatically shows the path of a coin as it falls through the mechanism.

Mechanical details of mechanism 18 are shown in FIGS. 2 and 3. Its mounting sleeve 19 is insertable endwise into post 14 and is seated on support stops. Mechanism 18 included two spaced apart side plates 28, 30, which are separated by an upper spacer 32 and a pair of lower spacers 34, 36. The lower spacers define a vertical guideway between them.

A ramp member 38 is captured and guided between the lower spacers 34, 36, and preferably is vertically movable between them. The ramp member 38 has a downwardly depending leg 40 which slides between the spacers 34, 36, and a cross head 42 having a top surface 44 which provides an inclined ramp. The upper or leading edge 46 (the left edge in FIG. 2) of the ramp is adjacent an upward extension of spacer 34; from this the ramp extends downwardly to a trailing edge 48. The adjusted vertical position of ramp member 38 is secured by a set screw 49.

A coin size limit opening 50 is formed in sleeve 26 above the leading end of the ramp. This opening is defined as a vertical slot, the bottom of which is adjacent the top end of spacer 34. The height of opening 50 is fixed by the lower end of a vertically adjustable coin size control screw 52, which extends downwardly from an overhanging portion of spacer 32. It can be seen that by turning the screw 52, the maximum size of the opening, and hence the maximum size of the coin which can be inserted, can be changed. Screw 52 is normally enclosed by cover 16 so that it is inaccessible.

The coin size limit opening 50, together with the side plates 28, 30 and the top surface 44 of the ramp, provides a path of coin movement from the opening 50 to an outlet 54 above the trailing edge 48 of the ramp. An inserted coin falls vertically, freely between the side plates, hits ramp surface 44 and rolls (or skids) down the ramp past detectors to be described, and falls from the trailing surface 48 directly into the coin box 24. At all times after insertion the coin is either free falling or is moving down ramp surface 44. The movement of the coin is not arrested until it lands in the coin box. Slugs are not diverted; every coin which is inserted falls into the box but the mechanism 18 energizes motor 12 only in response to the passage of proper coinage past the various sensors.

Preferably three different coin limiters or sensors are included: the coin size control screw 52 at the opening end, which limits the maximum size of the coin; a photocell sensor which insures that the coin is of a predetermined minimum size; and a magnet means which responds to magnetic slugs to prevent them from causing motor 12 to operate. More specifically, as the coin rolls down ramp 44 it passes an antiretraction flapper or dog 56 which comprises an arm pivotally mounted between the two side plates, and having a curved lower end which is engaged by the top of the coin as it rols past. The flapper 56 can rotate in the counterclockwise direction as seen in FIG. 2, to permit the coin to roll past, but if it is attempted to retrieve the coin, as by a string tied to it, the flapper cannot be rotated in the clockwise direction past the point at which it abuts a shoulder 58 on upper spacer 32. The manner in which the flapper is swung out of the way to permit passage of a coin down the ramp, but not reverse movement up the ramp, is illustrated by phantom lines in FIG. 2.

The magnetic slug detector comprises a permanent magnet 60 set in an opening in one side plate, and a magnetic reed switch 62 set opposite it in the other plate. The reed switch is of the type which changes its closed/open condition in response to a change in the magnetic field around it. Ordinarily the magnetic field of magnet 60 holds the reed switch in a position to permit motor 12 to be energized. Since no U.S. coins are magnetic, the passage of a normal coin past the magnet will not affect the field seen by the rred switch and the condition of the switch will not be changed. However, a magnetic slug will modify the force field and will cause the reed switch to change condition. This switch is connected through circuitry shown in FIG. 4, so that such a change in condition of the switch will prevent motor 12 from operating.

It should be noted that the magnet can be mounted on the opposite side plate from switch 62, or it can be mounted on the same side plate, adjacent to the magnet, provided that in any case the passage of a magnetic coin will result in a change in condition of the switch.

As previously explained the photoelectric means is used to sense that the coin is of a predetermined diameter. For this purpose a narrow beam of light is projected across the path of the rolling coin, so that the beam is interrupted by just the upper limb of a coin of the predetermined diameter. In other words, light beam interruption indicates that the coin is of the proper diameter and allows the operation of the motor to commence. For convenience, the coin control mechanism is preferably mounted from one of the side plates, and includes a light sensor or beam receptor 66, and a beam projector 68. The projector is provided at the end of a mounting shaft which projects across the slot above the path of the coin, and is bent reversely, toward the projector. This single mounting of source and projector facilitates installation and alignment. Such photocell means are known per se.

Figure 4:
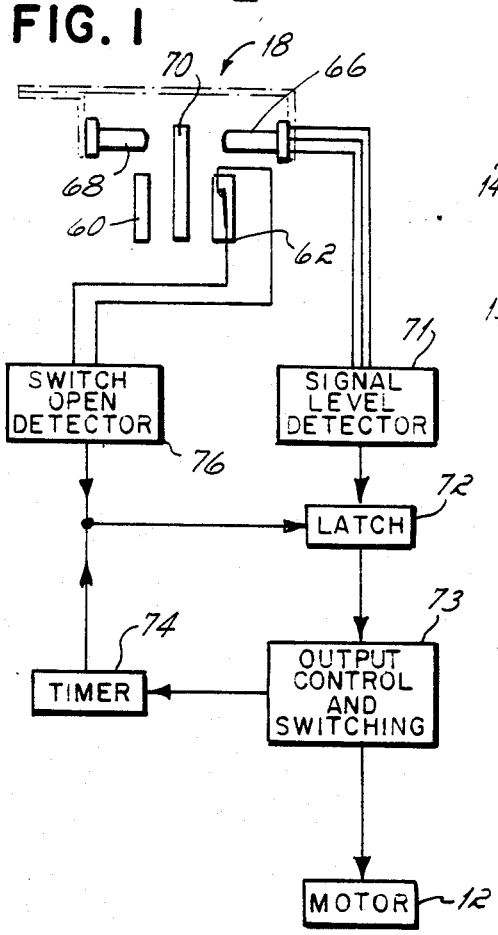
FIG. 4 is a diagrammatic illustration of a preferred form of electric circuit for operating the system.

FIG. 4 illustrates diagrammatically a circuit for operating motor 12 in response to a "non-magnetic" signal from the reed switch 62 and to a "minimum size OK" signal from the light sensor 66.

As shown diagrammatically in FIG. 4, a coin 70 inserted into the mechanism passes between the magnet 60 and the reed switch 62 and then between the beam projector 68 and the light sensor 66. In the illustrated system, the beam projector is an infrared light-emitting diode, and the light sensor 66 is a phototransistor. If the coin is of proper size, it will break the infrared light beam as it passes between the light transmitter 68 and the sensor 66, and thereby will produce a signal sensed by a signal level detector circuit 71.

The signal level detector circuit 71 sets a latch circuit 72 in response to this change in the signal level at the phototransistor receiver 66. When the latch circuit 72 is set, an output control and switching circuit 73 is activated to energize the motor 12 controlled by the mechanism.

In the case of a timed ride, the output control and switching circuit 73 also activates an adjustable timer circuit 74, which resets the latch circuit 72 after a preselected time interval. When the latch circuit is reset at the end of the preselected time interval, the output control and switching circuit 73 deactivates motor 12.

In the preferred embodiment, reed switch 62 is normally held closed under the influence of the magnetic field of magnet 60. If a coin or magnetic material passes between the magnet 60 and the reed switch 62, the magnetic field is interrupted, and the reed switch 62 opens. A switch-open detector circuit 76 is responsive to the opening of the reed switch 62 to reset the latch circuit 72 regardless of the output of the signal level detector 71. That is, even if a coin of a ferrious material is of the requisite size, the reed switch 62 and the switch-open detector 76 cooperate to reset the latch circuit 72, preventing activation of the output control and switching circuit 73 and of motor 12.

In the illustrated system, the magnet 60 and the reed switch 62 are located upstream along the coin path from the transmitter 68 and receiver 66. The reed switch 62 and the switch-open detector circuit 76 therefore cooperate to maintain the latch circuit 72 in a reset condition for a sufficient time to permit the coin to reach and pass the location of the light transmitter 68 and of the receiver 66. In this way, the latch circuit 72 is held in a condition by a coin of ferrious material until after the coin has passed the location of the light beam transmitter and the receiver, preventing improper setting of the latch circuit.

From the lower end of the ramp, the coin drops into the adjacent but preferably separate coin box 24. Like the coin control mechanism 18, the coin box is individually removable from post 14, and is positioned therein by a stop beneath it. The coin box is locked to the post by a lock 78 (FIG. 2), which projects up from the coin box on a support strap 79. Cover 16 must be unlocked and removed to gain access to either lock 20 or 78. The double bolts 80, 80 of cover lock 81 engage apertures in the side wall of post 14; the depending skirts of the cover block outside access to the bolt ends.

Having described the invention, what is claimed is:

1. A coin control system for use with a coin operated device, said system comprising, a pair of vertical, laterally spaced apart side plates, ramp means between said side plates and presenting a downwardly slanting ramp along which a coin can roll downwardly, a coin insertion opening above an upper end of said ramp, a magnet in one of said side plates, adjacent the path of coin movement down said ramp, a magnetic switch proximate to said magnet, said switch being responsive to a change in the magnetic field of said magnet when a slug passes said switch while moving downwardly on said ramp, photocell means projecting a narrow light beam across said ramp in a position to be interrupted only by the top of a coin of predetermined diameter on said ramp, means for receiving coins coming off a lower end of said ramp, each coin inserted through said opening falling onto said ramp and rolling continuously downwardly on said ramp past said magnet and photocell means and dropping into said receiving means, and circuit means responsive to a change of position of said magnetic switch when a magnetic slug passes it on said ramps, so as not to start operation of said coin-operated device, said circuit means further responsive to an interruption of said beam to initiate operation of said device unless said switch has changed position in response to a slug, said ramp means being vertically adjustable, with respect to said light beam, between said side plates, so that the ramp can be set a desired distance below said beam such that said beam is broken only by coins larger than a certain minimum diameter.

2. The coin control system of claim 1 wherein said ramp means is vertically movable between said side plates, and including means for securing said ramp means in a desired position.

3. The coin control system of claim 1 wherein said magnet and magnetic switch are mounted on opposite sides of said ramp, up the ramp from the light beam, and wherein the switch is connected to prevent operation of said device if the switch detects the passage of a magnetic slug.

4. The coin control system of claim 1 wherein the photocell means comprises a light source and a light receiver, both mounted from the same one of said side plates, said photocell means including a mount presenting one of said source and said receiver, said mount extending across the ramp to the other side plate and there returning toward the other of said mount and receiver, the mount being spaced above the ramp sufficiently that coins of predetermined size can pass beneath the mount but will interrupt a beam from said source to said receiver.

5. The coin control system of claim 1, further including operating circuitry which is mounted on one of said side plates.

6. The coin control system of claim 5, further wherein a noise generator is mounted on one of said side plates and is energized when a predetermined type of coin passes off said ramp.

7. The coin control system of claim 1, wherein said insertion opening is a vertical slot, the effective height of which is determined by a height adjustment screw which partially closes said slot.

8. The coin control system of claim 1, wherein said ramp means includes a T-shaped member between said side plates, said member having an angulated top surface which presents said ramp, said member having a vertical leg which is guided for vertical sliding movement between said side plates, and means engageable with said leg to secure the same in a given position with respect to said side plates.

9. The coin control system of claim 1, further including an anti-retraction dog swingably mounted above said ramp, said dog being rotatably to permit the passage of a coin down said ramp past it but blocking reverse movement of a coin up the ramp.

10. The coin control system of claim 1 mounted with a coin box below a lower end of said ramp, said coin box having an opening through which a coin falls into it from the lower end of the ramp, further wherein both said coin control mechanism and said coin box are removably mounted in a common housing, and each of them is separately lockable to said housing.

11. The coin control systems of claim 10, further including a removable cover for said housing which must be removed in order to gain access to unlock and remove each of the coin control mechanism and the coin box, said cover being lockable to said housing.

* * * * *